US006048005A

United States Patent [19]

Rotondi

[11] Patent Number: 6,048,005

[45] Date of Patent: Apr. 11, 2000

[54] STRIKER EXTENDER FOR PIVOTALLY OPENING REAR WINDOWS OF MOTOR VEHICLES

[76] Inventor: John Rotondi, HC 1A Main St., Pine Hill, N.Y. 12465

[21] Appl. No.: 09/173,311

[22] Filed: Oct. 15, 1998

[51] Int. Cl.[7] ..... E05C 17/04

[52] U.S. Cl. ..... 292/262; 292/341.17

[58] Field of Search ..... 292/262, 263, 292/271, 278, 338, 340, 341.17, 341.18, 246; 403/93, 94, 96, 101; 16/DIG. 38, 445, 438, 437

[56] References Cited

U.S. PATENT DOCUMENTS

| | | | |
|---|---|---|---|
| 1,036,890 | 8/1912 | Ogden . | |
| 1,311,258 | 7/1919 | Wolf | 292/246 |
| 1,851,631 | 3/1932 | Johnson . | |
| 2,280,165 | 4/1942 | Sebastian . | |
| 2,727,753 | 12/1955 | Johnson | 16/437 |
| 2,985,917 | 5/1961 | Sunday | 292/246 |
| 3,093,258 | 6/1963 | Turner . | |
| 3,674,299 | 7/1972 | Kelley | 292/262 |
| 4,070,050 | 1/1978 | Glock et al. | 292/339 |
| 4,278,280 | 7/1981 | Rashbaum | 292/263 |
| 4,307,907 | 12/1981 | Barrowman et al. | 292/339 |
| 4,322,103 | 3/1982 | Acton | 292/288 |
| 4,393,754 | 7/1983 | Hough | 296/217 |
| 4,593,946 | 6/1986 | Rich | 292/288 |
| 4,609,216 | 9/1986 | Baker et al. | 292/262 |
| 4,667,993 | 5/1987 | Hannesson et al. | 292/339 |
| 5,163,724 | 11/1992 | Conte | 292/258 |
| 5,165,742 | 11/1992 | Frayne | 292/262 |
| 5,165,749 | 11/1992 | Frayne | 292/262 |
| 5,551,738 | 9/1996 | Thorlton | 292/262 |
| 5,876,075 | 3/1999 | Barthelmess | 292/247 |

*Primary Examiner*—B. Dayoan
*Assistant Examiner*—Gary Estremsky
*Attorney, Agent, or Firm*—Sandra M. Kotin

[57] ABSTRACT

An extender for the U-shaped striker found on the pivotally opening rear window of a motor vehicle to engage the rear door locking mechanism of the vehicle and maintain the rear window in a partially opened yet securely locked position for ventilation of the interior of the vehicle. The striker extender being U-shaped and pivotally affixed to the striker so that it can easily be moved into a first or parallel position for use and a second or perpendicular position for storage. The striker extender does not have to be removed and is always ready for use and easily placed in the desired position without the need for any tools or special skills. Once the window is locked in the partially opened position, the striker extender cannot be removed from outside the vehicle and therefore unauthorized access to the vehicle's interior is not possible.

7 Claims, 3 Drawing Sheets

STRIKER EXTENDER FOR PIVOTALLY OPENING REAR WINDOWS OF MOTOR VEHICLES

FIELD OF THE INVENTION

The instant invention relates to an extender for the latch or striker bar of the locking mechanism of the pivotally attached rear windows found in a variety of vehicles so as to maintain such a window in partially opened orientation for ventilation of the interior of the vehicle.

BACKGROUND OF THE INVENTION

Today there are many four wheel drive vehicles, sport utililty vehicles, station wagons and hatchbacks having a rear window that is pivotally attached at its upper edge to a framework that is part of the vehicle's rear entry means. Such windows are locked by means of a latch and hook type lock that must be opened using the vehicle door key and a handle located on the rear door. These windows open upward and can only be in one of two modes, the open position for access to the rear compartment of the vehicle, or in the totally closed position. Driving with the window in the open position is dangerous and not advisible, especially when there are children or pets in the vehicle. Many of these vehicles do not have rear side windows that open and therefore there is no means to create air circulation for effective ventiliation of the interior of the vehicle.

There have been attempts to solve this problem with devices that can be attached to the striker or latch portion of the rear window lock to maintain the window in a partially opened orientation.

Thorlton, in U.S. Pat. No. 5,551,738 has developed a rigid link-like device that can be introduced by hooking it into the U-shaped striker thus forming an extension thereof which engages the locking means. The device is introduced by a twisting motion which makes it difficult to remove once in place. The device does not fill the opening in the striker and the window can bounce slightly as the vehicle moves. Some strength and dexterity are required to insert and remove the device and it must be reintroduced each time it is needed since the window cannot be completely closed with the device in place.

Frayne, in U.S. Pat. No. 5,165,742 also teaches an extender for the striker. The device of Frayne must also be placed at the time it is needed and removed when not in use. This device consists of a U-shaped extender mounted in a solid body with a removable face plate. The body is placed over the striker, covering most of it, and the face plate held in place with a wing bolt. The U-shaped extender engages the locking means. This extender forms a rigid unit with the striker and the window cannot bounce when it is in place. However, the extender can easily be separated from the striker by turning the wing bolt and removing the face plate. This can be accomplised when the device is in place and the vehicle is locked. The device remains engaged with the hook portion of the lock, but the striker is free and the rear window can easily be opened to gain access to the interior of the vehicle.

A hinged, rigid extension means was developed by Baker et al. in U.S. Pat. No. 4,609,216 to maintain the cab door of a material handling implement such as a tractor in a partially opened orientation for ventilation within the cab.

An adjustable rigid bar having one end fitted with a lug and the other with a slotted blade, used to keep an automobile door partially opened when body work is being performed, has been disclosed by Rich (U.S. Pat. No. 4,593,946) and a similar, though non-adjustable device is taught by Acton (U.S. Pat. No. 4,322,103).

Adjustable devices have also been developed to keep the trunk of a car opened during transport of large objects. (Hannesson et al., U.S. Pat. No. 4,667,993; Rashbaum, U.S. Pat. No. 4,278,280; and Glock et al., U.S. Pat. No. 4,070,050) These devices maintain a considerable opening space and would not be practical for the pivotally opening rear window of a vehicle.

Since the lack of sufficient ventilation can be dangerous for a driver, there is a need for a device that can maintain a vehicle's pivotally opened rear window in a partially opened orientation. Such a device should not have to be installed when needed and removed when not needed, and should be easily utilized without any tools, and by anyone, even with limited dexterity. There is a need for such a device that enables the rear window to be securely locked in the partially open orientation so that it cannot bounce when the vehicle is driven and so that there can be no unauthorized access to the interior of the vehicle.

BRIEF SUMMARY OF THE INVENTION

The present invention provides an extension to the U-shaped striker of the locking mechanism of a variety of vehicles having pivotally opening rear windows. The extension is permanently attached to the vehicle's striker and can be utilized or retracted with a simple motion and without the need for a tool of any kind. The extension, when utilized, enables the rear window to remain slightly opened so that there is air circulation throughout the vehicle, yet children and pets are quite safe. The interior ventilation made possible by the use of this extension also assists to prevent fogging of the interior of the vehicle's windows in inclement weather and to exhaust smoke and odors originating from the use of tobacco products.

It is an object of the present invention to provide an extension for the rear window striker that can be used with a variety of vehicles.

It is another object of the present invention that the extension be easily utilized by anyone, even with limited dexterity or mechanical ability.

A further object of the present invention is to provide an extension that remains attached at all times, cannot get lost, and is always ready for use when needed.

A still further object of the present invention is to provide a striker extension that is ready for use without the need for any tools.

A further object of the present invention is to have an extension for the striker that is not detached from the striker when not in use, but is merely raised to a storage position.

Another object of the present invention is to have a device that resists tampering from outside of the vehicle and maintains the interior of the vehicle as secure when the device is in use as it is when the window is locked in the closed position.

An object of the present invention is to have a device that, when in use, enables the vehicle to be easily unlocked using the usual vehicle key and handle.

A further object of the present invention is to have a device that is of simple construction, economical to manufacture, easy to install, and that works well.

A still further object of the present invention is to provide an extension to the striker that is rigid and will not permit any bouncing or other movement of the window when the window is in the partially opened mode even as the vehicle moves over rough terrain.

Other features and advantages of the invention will be seen from the following description and drawings wherein similar reference characters are used to designate corresponding parts in all of the views.

DETAILED DESCRIPTION OF THE INVENTION

Figure 1:
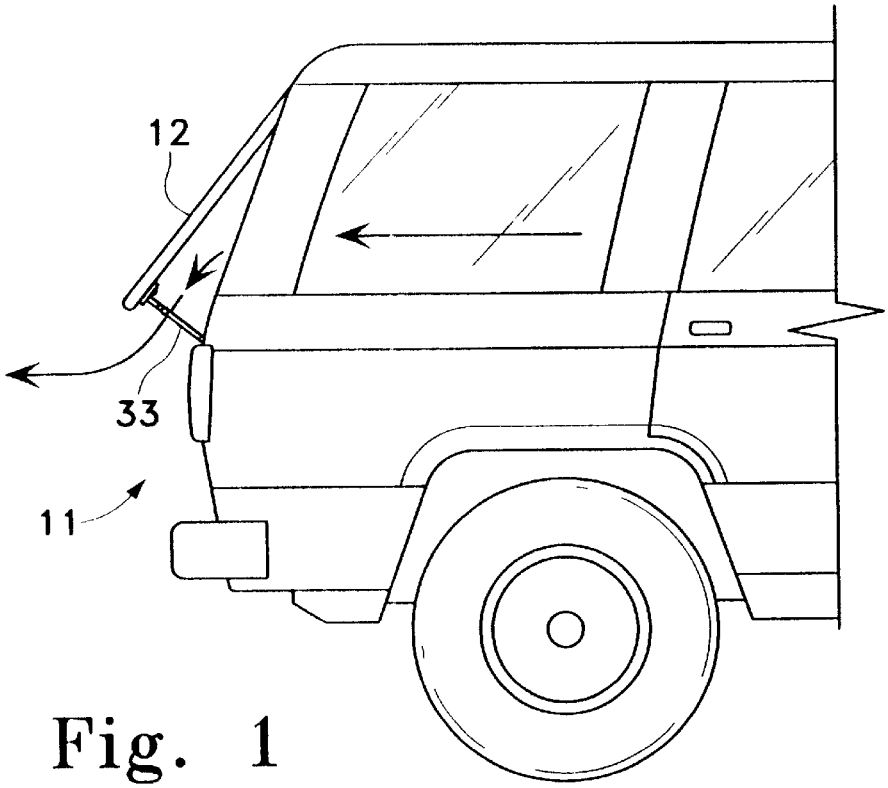
FIG. 1 is a side view of the rear portion of a utility vehicle having lift rear window in the partially open mode using the present invention.
Figure 10:
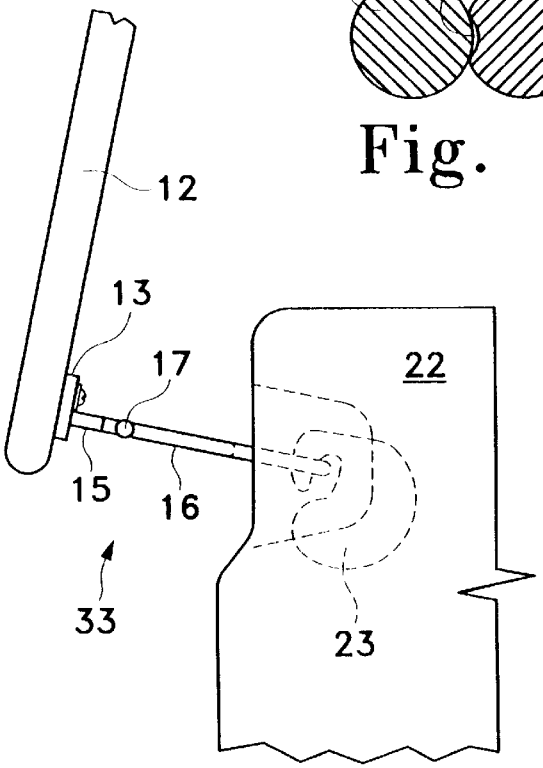
FIG. 10 is a close-up side view of a partially opened vehicle window showing the extender engaged by the locking mechanism.

The pivotally opening rear window 12 of a motor vehicle is locked when the striker 15 affixed to the window is engaged by the locking mechanism 23 located within the rear door 22. When the striker is so engaged, the rear window is tightly closed. By attaching an extender 16 to the striker, the window can be securely held in a partially opened position. FIG. 1 is illustrative of the rear portion 11 of a motor vehicle having such a pivotally opening rear window 12 with the striker-extender combination 33 in use to maintain the rear window in the partially opened position. FIG. 10 is a close-up of the rear window 12 of the vehicle illustrating how the locking mechanism 23 engages the extender 16. The rear window 12 of the vehicle is securely locked when either the striker 15 or the extender 16 is engaged by the locking mechanism. The difference is only whether the window is tightly closed or partially opened. To activate the locking mechanism 23 the user rotates it when turning the handle which is mounted on the vehicle's rear door 22. The handle is releasable by using the vehicle door key.

Figure 2:
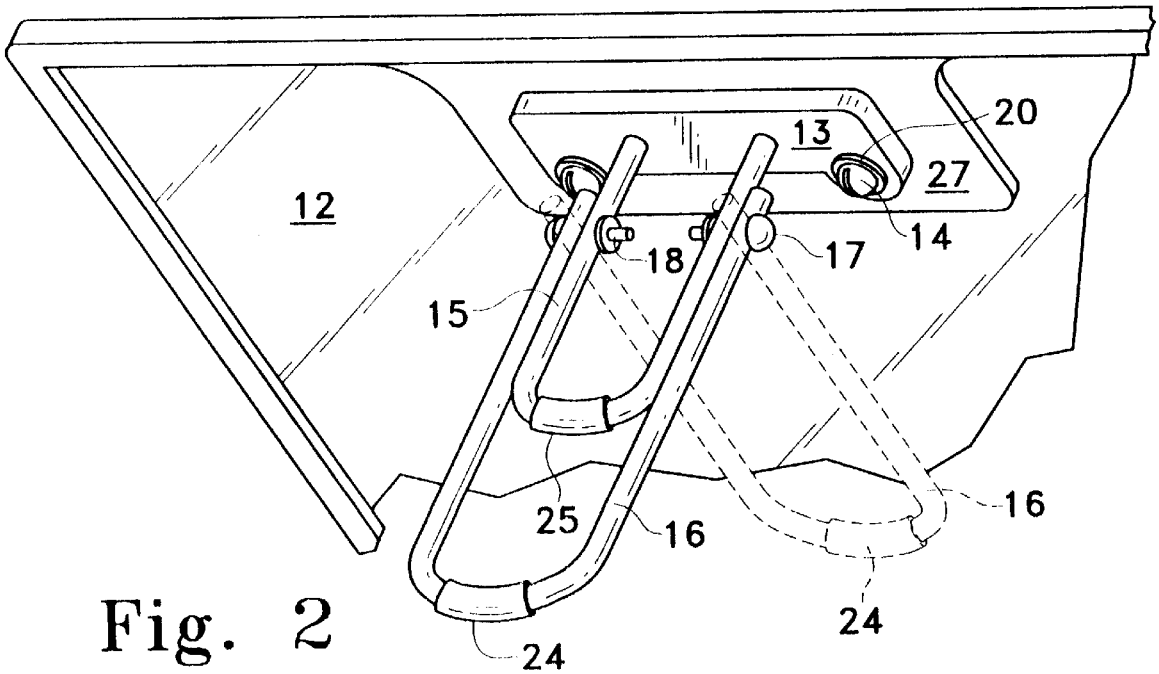
FIG. 2 is perspective close-up view of a portion of the rear window of a utility vehicle showing the complete striker-extender unit attached to the window.
Figure 7:
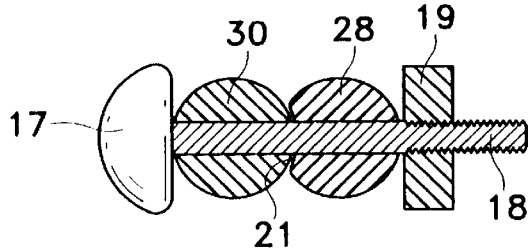
FIG. 7 is a sectional view through line 7—7 of FIG. 4.
Figure 8:
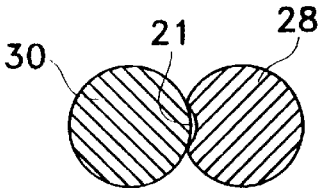
FIG. 8 is a sectional view through line 8—8 of FIG. 4.

The striker 15 is U-shaped and circular in cross-section. (Note FIGS. 7, 8 and 9) As seen in FIG. 2 it is integral with a base 13 which can be attached by means of mounting screws 14 to a plate 27 that is a part of the window frame. Washers 20 may be used with the screws. Depending on the make and model of the vehicle, other attachment means may be used. Usually the striker 15 and base 13 are of singular construction. The "U" is formed by two parallel legs 28 joined to a crosspiece or hasp 29. The legs 28 of the striker are just long enough for the hasp 29 to engage the locking mechanism 23 resulting in a tight and secure closure of the rear window 12.

The extender 16 is also U-shaped and circular in cross-section with parallel legs 30 joined to a hasp 31. The parallel legs 30 of the extender are somewhat longer than the legs 28 of the striker. This difference in length determines the degree to which the rear window 12 will be maintained in the open position. When the extender hasp 31 engages the locking mechanism 23 the rear window 12, though partially opened, is held fast and cannot oscillate when the vehicle is driven. The extent of the opening is designed to permit air circulation throughout the vehicle without providing enough of an opening to enable access to or entry into the interior of the vehicle.

Figure 4:
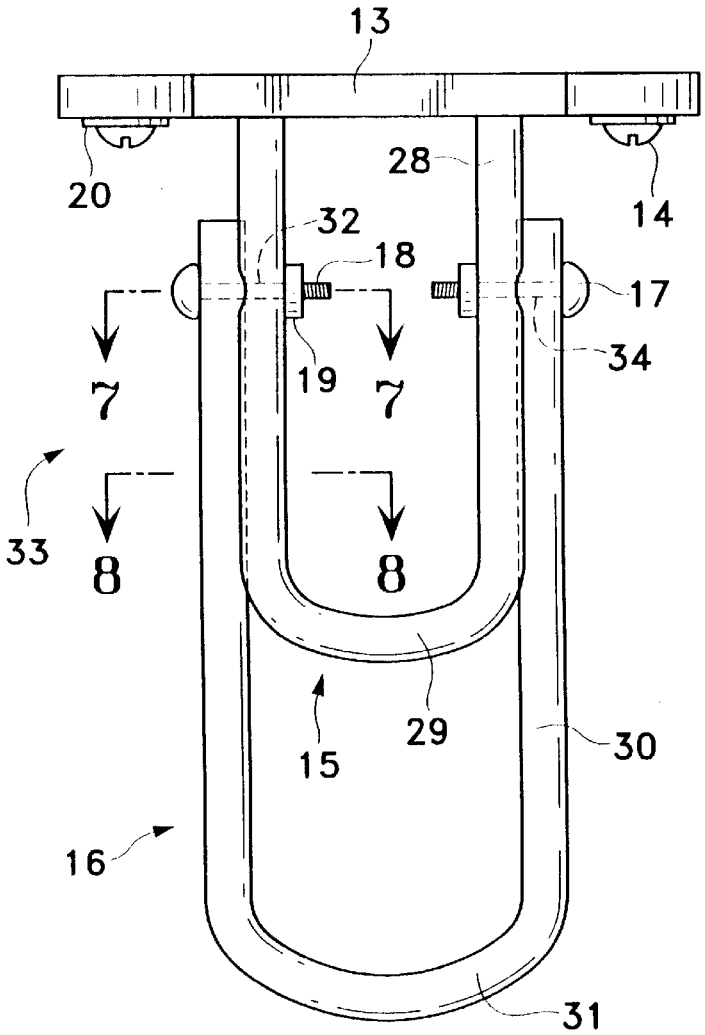
FIG. 4 is a front plan view of the striker-extender unit with the extender in its parallel or use position.
Figure 9:
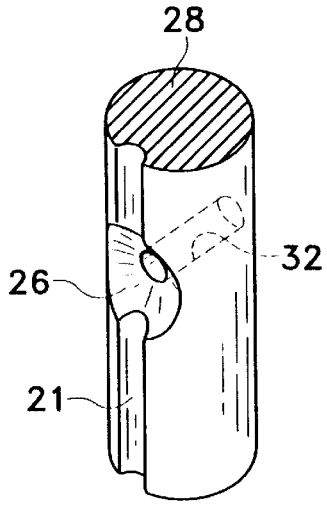
FIG. 9 is a close-up perspective view of a portion of a striker leg showing the recess adjacent the bore to hold the extender in storage position.

The extender is joined to the striker by means of a threaded pivot pin 18. There is a bore 34 near the end of each extender leg 30 and a similar bore 32 in each striker leg 28 at a point proximate its joinder to the base 13. The threaded pivot pin 18 passes through the bore 34 in the extender leg 30 then through bore 32 in the latch leg 28 and is secured in place with a threaded nut 19. These structures are seen in FIGS. 4 and 9. The larger head portion 17 of the pivot pin prevents it from becoming dislodged. A rivet or other pivot means known in the art may be used.

Figure 3:
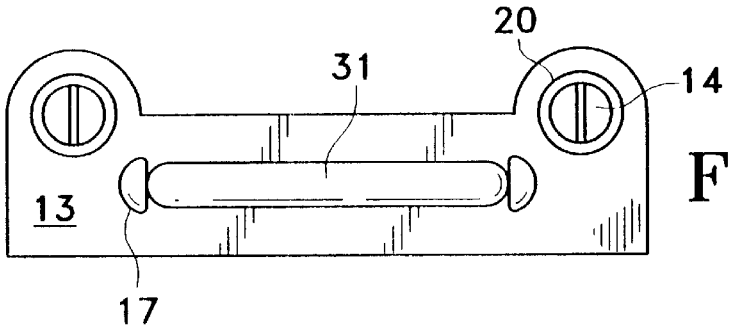
FIG. 3 is a bottom plan view of the striker-extender unit with the extender in its parallel or use position.
Figure 5:
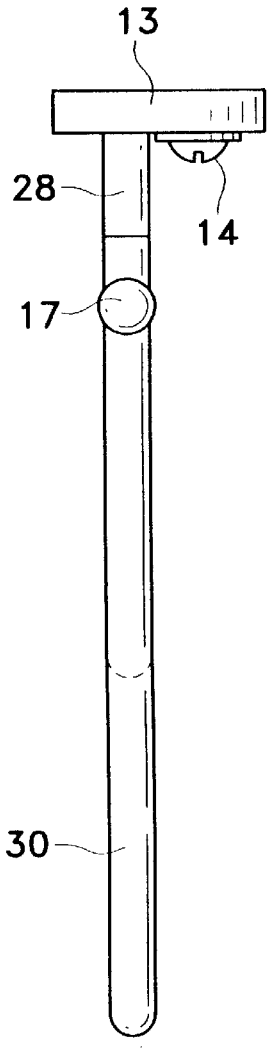
FIG. 5 is a side plan view of the striker-extender unit of FIG. 4.
Figure 6:
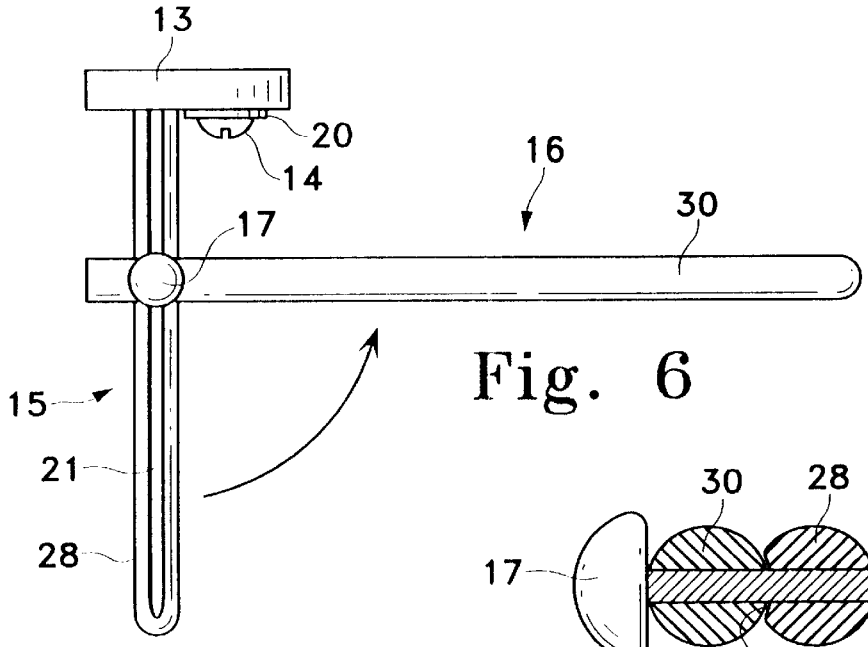
FIG. 6 is a side plan view of the striker-extender unit with the extender in its perpendicular or storage position.

When the extender 16 is needed it is rotated into a first position where the legs of both the striker and the extender are parallel as shown in FIGS. 3, 4 and 5. When not in use the extender is rotated into a second position where the extender legs 30 are perpendicular to the striker legs 28 as seen in FIG. 6.

To insure that the extender remains in the desired position, means to securely seat the extender are provided. There is a channel 21 along the entire outside surface of each striker leg 28 extending from the base 13 to the hasp 29. This channel 21 is visible in FIGS. 6, 7, 8 and 9.

When the extender 16 is lowered to the first or parallel position it snaps into the channel 21 and is held there securely. When the extender 16 is not in use it is raised to the second or perpendicular position illustrated in FIG. 6. There is a groove or recess 26 in the outside surface of each striker leg 28 about the area of the bore 32 and perpendicular to the channel 21. When the extender is raised the extender leg 30 snaps into this recess 26 and is thereby held in the perpendicular position. The recess 26 can be seen clearly in FIG. 9.

The extender remains attached to the striker at all times. It is ready for use when needed and only a simple movement places it in the desired position. No tools are required and no special skills are necessary to utilize the extender. The change of position can be performed with one hand. The striker 15 and plate 13, as previously noted, are manufactured as a single unit, usually of a rigid plastic material. The striker extender 16 can be made of the same material. Such plastics have sufficient resiliency to permit the extender leg to snap into and out of the channel or recess as needed and yet remain securely seated once in place. Both can be made of any rigid moldable material, polymeric or metallic, so long as the material possesses the necessary resiliency.

The hasp portions of the striker and the extender are subject to wear from contact with the locking mechanism which is usually made of metal. To lessen such wear and prolong the life of both components protective sleeves 25 and 24 can be placed on the hasps. These are seen in FIG. 2. Such sleeves can be manufactured from any applicable wear resistant material known in the art.

The striker extender 16 can be dimensioned to be accommodated by a variety of vehicle strikers. The length of the extender legs 30 can be varied to maintain the rear window opened to the desired degree. A typical extender would project 2 to 4 inches (5.1 cm to 10.2 cm) beyond the striker hasp 29.

It would not be practicable to sell the extender separately since it not only must be pivotally attached to the striker, but the retaining channel and recess must be present to achieve optimum performance. The extender is best sold together with the striker as a unit to replace the existing vehicle striker. The striker-extender combination can be installed by the vehicle manufacturer or vehicle distributor. It can also be sold by a vehicle parts distributor for installation by the vehicle owner. The installation is simple and easily accomplished with a screw driver. The screws in the striker base are removed and the striker is merely lifted off. The striker-extender unit is thereafter installed as the replacement.

While one embodiment of the present invention has been illustrated and described in detail, it is to be understood that this invention is not limited thereto and may be otherwise practiced within the scope of the following claims.

ROTONDI PARTS LIST

11 rear end of vehicle
12 rear window of vehicle
13 base for rear window latch
14 attaching screw
15 latch (striker)
16 latch extender
17 pivot pin head
18 threaded pivot pin
19 threaded nut
20 washer
21 channel for seating extender when in use position
22 rear door of vehicle
23 locking mechanism
24 friction sleeve on extender
25 friction sleeve on latch
26 recess to seat extender when in stored position
27 rear window frame plate
28 leg of latch
29 latch hasp
30 leg of extender
31 extender hasp
32 bore in leg of latch
33 latch extender—latch combination
34 bore in leg of extender

I claim:

1. An extender in attached relation to a striker affixed to a pivotally opening rear window of a motor vehicle for coaction with a hooked bolt locking mechanism to lock said window, said striker having a first U-shaped element contiguous with a base and having two substantially parallel legs integral with a hasp, said extender comprising:

a second U-shaped element having two substantially parallel legs, longer than the legs of the striker, integral with a hasp and defining a U-shaped cavity, said second U-shaped element being dimensioned to contain the first U-shaped element within the cavity; and pivot means to enable the legs of the second U-shaped element to depend from the legs of the first U-shaped element at pivot points proximate the base and to thereby enable the extender to assume a first position such that the legs of the extender are parallel with the legs of the striker and project a distance therebeyond, and a second position such that the legs of the extender are perpendicular to the legs of the striker;

whereby when the extender is in the first position and engaged by the locking mechanism the window is locked in a partially opened orientation for ventilation of the interior of the vehicle, and when the extender is in the second position the striker can be engaged by the locking mechanism to lock the window in a closed orientation.

2. An extender in combination with a striker for fixation to a pivotally opening rear window of a motor vehicle and for coaction with a hooked bolt locking mechanism to lock said window, said extender and striker combination comprising:

a U-shaped striker element contiguous with a base and having two substantially parallel legs integral with a hasp;

a U-shaped extender element having two substantially parallel legs, longer than the legs of the striker element, integral with a hasp, and defining a U-shaped cavity, said extender element being dimensioned to contain said striker element within the cavity; and pivot means to enable the legs of the extender element to depend from the legs of the striker element at pivot points proximate the base and to thereby enable the extender element to assume a first position such that the legs of the extender element are parallel with the legs of the striker element and project a distance therebeyond, and a second position such that the legs of the extender element are perpendicular to the legs of the striker element;

whereby when the extender element is in the first position it can be engaged by the locking mechanism to lock the window in a partially opened orientation for ventilation of the interior of the vehicle, and when the extender element is in the second position the striker element can be engaged by the locking mechanism to lock the window in a closed orientation.

3. An extender and striker combination as in claim 2 further comprising seating means to seat the extender element securely when in the first position so that it will not become dislodged during use.

4. An extender and striker combination as in claim 3 wherein the seating means comprises a longitudinal groove situated on an outside surface of each leg of the striker element and passing through the pivot point thereof.

5. An extender and striker combination as in claim 2 further comprising seating means to seat the extender element securely when in the second position so that it will not become dislodged when not in use.

6. An extender and striker combination as in claim 5 wherein the seating means to seat the extender element securely when in the second position comprises a lateral groove on an outside surface of each leg of the striker element about the pivot point thereof.

7. A method for reversibly maintaining a pivotally opening rear window of a vehicle in a partially opened and locked orientation, said window being usually locked and closed by means of a striker designed to coact with a hooked bolt locking mechanism, said striker having been removed and replaced by an extender and striker combination comprised of a U-shaped striker element contiguous with a base and having two substantially parallel legs integral with a hasp, and a U-shaped extender element having two substantially parallel legs, longer than the legs of the striker element, integral with a hasp, and defining a U-shaped cavity, said extender element being dimensioned to contain said striker element within the cavity, and pivot means to enable the legs of the extender element to depend from the legs of the striker element at pivot points proximate the base and to thereby enable the extender element to assume a first position such that the legs of the extender element are parallel with the legs of the striker element and project a distance therebeyond, and a second position such that the legs of the extender element are perpendicular to the legs of the striker element, said method comprising:

placing the extender element in the first position;

closing the rear window until the extender element coacts with the locking mechanism and the rear window is maintained in a partially opened orientation;

releasing the locking mechanism and further opening the rear window;

placing the extender element in the second position;

closing the rear window until the striker element coacts with the locking mechanism and the rear window is maintained in a closed orientation.

* * * * *